US005096793A

United States Patent [19]

Osawa et al.

[11] Patent Number: 5,096,793

[45] Date of Patent: Mar. 17, 1992

[54] PHOTOSENSITIVE MEMBER EXCELLENT IN ANTIOXIDATION

[75] Inventors: Izumi Osawa; Isao Doi, both of Osaka, Japan

[73] Assignee: Minolta Camera Kabushiki Kaisha, Osaka, Japan

[21] Appl. No.: 544,182

[22] Filed: Jun. 26, 1990

[30] Foreign Application Priority Data

Jun. 28, 1989 [JP] Japan ..... 1-166338
Jun. 28, 1989 [JP] Japan ..... 1-166339

[51] Int. Cl.[5] ..... G03G 5/047; G03G 5/14

[52] U.S. Cl. ..... 430/58; 430/59; 430/66; 430/67

[58] Field of Search ..... 430/58, 59, 66, 67

[56] References Cited

U.S. PATENT DOCUMENTS 4,727,009 2/1988 Tixkai ..... 430/59 X
4,873,165 10/1989 Kamakida et al. ..... 430/66
4,882,253 11/1989 Kato et al. ..... 430/58 X
4,889,784 12/1989 Champ et al. ..... 430/59 X

FOREIGN PATENT DOCUMENTS 58-62654 4/1983 Japan .
59-135477 8/1984 Japan .
59-136744 8/1984 Japan .
59-155844 9/1984 Japan .
59-155845 9/1984 Japan .
12551 1/1985 Japan ..... 430/58
12552 1/1985 Japan ..... 430/58
63-63046 3/1988 Japan .
96662 4/1988 Japan ..... 430/58

*Primary Examiner*—Roland Martin
*Attorney, Agent, or Firm*—Burns, Doane, Swecker & Mathis

[57] ABSTRACT

The present invention relates to a photosensitive member comprising:

an electrically conductive substrate, an organic photosensitive layer formed on or over the electrically conductive substrate, the organic photosensitive layer comprising an antioxidant and/or a charge transporting material, and a surface protective layer formed on the organic photosensitive member, characterized by that the antioxidant and/or the charge transporting material is (are) contained in a more increased quantity with being closer to the interface between the surface protective layer and the organic photosensitive layer.

12 Claims, 10 Drawing Sheets

PHOTOSENSITIVE MEMBER EXCELLENT IN ANTIOXIDATION

BACKGROUND OF THE INVENTION

The present invention relates to an organic photosensitive member excellent in antioxidation, in particular ozone resistance.

Recently, a large number of organic photosensitive members have been proposed and practically used as electrophotographic sensitive members.

However, the organic photosensitive members are low in surface hardness, so that in the case where they are practically used inside an electrophotographic machine, the photosensitive layer is worn by the contact with developer, transfer paper, cleaning member and the like and thus the layer-thickness of the photosensitive layer is reduced after the long-term use and the surface potential is reduced, whereby the sufficient image concentration can not be obtained.

In addition, in an electrophotographic machine with the mechanism for compulsorily maintaining the surface potential of the photosensitive member constant by, for example, changing an output of the charger with monitoring by means of the surface potentiometer and charging by the scorotron method incorporated therein, it becomes necessary as the surface thickness decreases that the charging quantity to be applied to the surface is increased to maintain the surface potential constant, so that the sensitivity is lowered and the foggy image is generated after the long-term use.

So, in order to improve the wear resistance of the organic photosensitive member, a large number of proposals of forming a surface protective layer on the outermost surface have been made. Such a surface protective layer is generally formed on the photosensitive layer in a layer-thickness of about several μm or less so that the residual potential may not be generated and the irradiation ray may be effectively introduced into the photosensitive layer not to lead to the reduction of the sensitivity.

However, the surface of the photosensitive member in the practical electrophotographic machine is damaged by the corona discharge from various kinds of charger aiming at the provision of the surface charge, the transfer of the developer, the separation of the transfer paper from the photosensitive member and the like.

The damages by charging include ionic damages by corona ions, ozone damages by the ozone gas generated by the corona discharge and the like, which influence adversely much upon the performances of the photosensitive member.

This adverse influence is explained as follows with reference to the constitution of the photosensitive member, which has been generally adopted and composed of a charge generating layer and a charge transporting layer formed on an electrically conductive substrate in this order.

The ozone gas itself is strong in oxidizing effect enough to deteriorate a charge transporting material in the charge transporting layer.

The concentration of the ozone gas inside the usual electrophotographic machine is about 1 ppm or less. But, as the photosensitive member is exposed to the ozone atmosphere repeatedly for a long time, the charge transporting material is oxidized gradually from the outermost surface to form a so-called ozone-deteriorated region.

The charge transporting layer generally has the remarkably porous constitution at a molecular level due to the existence of so-called byways of solvents formed by the evaporation of the solvents in the preparation, the physical impact destruction resulting from the collision of ions when charged and the like, so that it is remarkably permeable to s, this ozone. According to the present inventors' knowledge ozone-deteriorated region generally reaches about 5 μm under the surface protective layer after the long-term use.

In the organic photosensitive member which has not a surface protective layer, the ozone-deteriorated region is worn out adequately by contact with a member brought into contact with the photosensitive member, so that it may show a disadvantage resulting from the wear of the photosensitive layer but no bad influence resulting from the ozone-deteriorated layer occurs.

However, because the organic photosensitive member with the surface protective layer is not worn, the ozone-deteriorated region is not removed but gradually formed and also its region is expanded.

If the surface protective layer is so chemically stable and so dense that the intrusion of ozone can be perfectly prevented, the ozone-deteriorated layer must not be formed. But such the dense surface protective layer can not be substantially prepared. Moreover the surface protective layer is damaged by oxidizing effects of ozone, physical destructions by ion-impacts or the like. Therefore, ozone molecules reach the photosensitive layer through the surface protective layer.

In the ozone-deteriorated region, the mobility of carriers is reduced and the carriers, which are moving, are trapped, so that the sensitivity is reduced and the residual potential is increased.

In addition, the trapped carriers are recombined with the surface charges when recharged to lead to the reduction of the surface potential.

Furthermore, when the photosensitive member, in which the ozone-deteriorated region is formed, is installed in the electrophotographic machine to be used under the high-temperature and high-humidity conditions, the moisture in the atmosphere reaches the ozone-deteriorated layer to be absorbed, whereby an electric resistance is reduced remarkably to generate the so-called image flow.

The invention aiming at the prevention of the ozone-deterioration has been disclosed in, for example, Japanese Patent Application Laid-Open No. 59-135477 or Japanese Patent Application Laid-Open No. 59-136744.

Japanese Patent Application Laid-Open No. 59-135477 discloses a photosensitive member of binder type containing phthalocyanines in which antioxidants or mixtures thereof with synthetic waxes are applied to an outer surface of said photosensitive member.

It is, however, produced by the applying method, so that if it is practically used inside a copying machine, the antioxidants and the like applied onto the surface of the photosensitive member are removed by the contact with the developer, the transfer paper, the cleaning member and the like to become short of the stability of the photosensitive member. Its durability with respect to copy is at most about several thousand times of copy.

Japanese Patent Application Laid-Open No. 59-136744 discloses a photosensitive member comprising a photosensitive layer with photoconductive powders dispersed in binder resins and an insulating protective layer containing antioxidants formed on said photosensitive layer.

Contrary to the present invention characterized in that antioxidants are contained in a charge transporting layer, antioxidants are contained in the surface protective layer in the above described invention. In addition, in order to achieve the sufficient resistance to oxidation, it is necessary to increase a layer-thickness of the insulating protective layer. In this case, the residual potential is apt to be generated.

Furthermore, this invention can not be applied to insulating protective layers to which antioxidants can not be added in view of the preparation method.

The inventions paying attention to the charge transporting material in order to prevent the ozone-deterioration have been disclosed in, for example, Japanese Patent Application Laid-Open Nos. 63-63046, 59-155844, 59-155845, 58-62654 and the like.

Japanese Patent Application Laid-Open No. 63-63046 discloses a laminate type photosensitive member comprising a substrate and a charge generating layer and a charge transporting layer formed on said substrate, wherein the concentration of the charge transporting material contained in the charge transporting layer is continuously changed. The charge transporting material is contained in an more increased quantity in the direction to the substrate. Thus, the insulating property and the hardness in the vicinity of the surface are improved and additionally the charge transporting material is prevented from depositing on the surface.

In the present invention, the charge transporting material is contained more in the direction to the surface to prevent the ozone-deterioration of the charge transporting material in the vicinity of the surface and secure the suitable transportability even after the long-term use. Accordingly, the present invention is completely different from the above described invention.

Japanese Patent Application Laid-Open Nos. 59-155844 and 59-155845 disclose a laminate type electrophotographic photosensitive member, characterized in that a layer composed of organic acceptor materials and a layer with donor materials of low molecular weight dispersed in resins are formed on an electrically conductive substrate to form a thin layer of charge-transfer complex on an interface therebetween. However, the above described invention relates to a method for preventing the charge transfer through the interface in the laminated type photosensitive layer and does not suggest the prevention of the deterioration in ozone resistance at all.

Japanese Patent Application Laid-Open No. 58-62654 discloses a photosensitive member with charge transporting materials ununiformly dispersed in a charge transporting layer. However, the charge transporting materials are not contained under the condition that they are distributed at the specified concentration and it is an object of Japanese Patent Application to improve the sensitivity. The ozone resistance is not suggested at all.

SUMMARY OF THE INVENTION

The present invention has been achieved in view of the above described matters and it is an object of the present invention to prevent the ozone-deterioration of the surface portion of an organic photosensitive layer and thus secure the suitable charge transportability for a long time.

The present invention relates to a laminate type photosensitive member comprising at least an organic photosensitive layer and a surface protective layer formed on an electrically conductive substrate characterized in that antioxidants or charge transporting materials are contained in an more increased quantity with being closer to an interface (a boundary) between said surface protective layer and said organic photosensitive layer.

DETAILED DESCRIPTION OF THE INVENTION

The present invention provides a photosensitive member exhibiting no deterioration of sensitivity and increase of residual potential due to the formation of an ozone-deteriorated region, no layer-wearing for a long time and stabilized sensitivity characteristics.

The above object of the present invention can be achieved by containing antioxidants and/or charge transporting materials in an more increased quantity with being closer to an interface between a surface protective layer and an organic photosensitive layer in a photosensitive member.

That is, the present invention relates to a photosensitive member comprising:

an electrically conductive substrate, an organic photosensitive layer formed on or over the electrically conductive substrate, the organic photosensitive layer comprising an antioxidant and/or a charge transporting material, and a surface protective layer formed on the organic photosensitive member, characterized by that the antioxidant and/or the charge transporting material is (are) contained in a more increased quantity with being closer to the interface between the surface protective layer and the organic photosensitive layer.

In the case where the charge transporting materials are used in order to prevent the ozone-deterioration, the charge transporting materials are contained in an more increased quantity with being closer to the interface between the surface protective layer and the photosensitive layer. It is because the ozone-deterioration of the photosensitive layer occurs within a depth about 5 μm under the surface protective layer and the degree of the ozone-deterioration is more severer with being closer to the surface protective layer. Therefore, the still more effective prevention of the ozone-deterioration is achieved according to the present invention.

Figure 1:
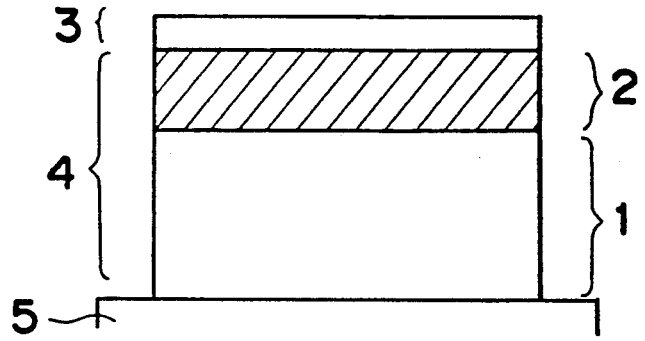
FIG. 1 is a schematic sectional view showing a constitution of a photosensitive member according to the present invention.

Hereinafter, as shown in FIG. 1, a layer portion, in which the ozone-deterioration is apt to occur, being closer to the interface between a surface protective layer (3) and an organic photosensitive layer (4) formed on an electrically conductive substrate (5), is referred to as a second region (2) and a layer region below said second region (2) is referred to as the first region (1) for convenience of the explanation.

The second region means, as above described, the region of about 5 μm, preferably 1–4 μm in depth in the photosensitive layer under the surface protective layer.

It can be thought that the first region is the region other than the second region of the organic photosensitive layer.

The content of the charge transporting materials in the second region is set at 1 to 9, preferably 2 to 7, as referred to as a ratio of a weight of the charge transporting materials to a weight of the constituent resins of the photosensitive layer. If the content of the charge transporting materials is excessively high, the electrical resistance of the photosensitive layer is lowered to deteriorate the chargeability. On the contrary, if the content of the charge transporting materials is excessively low, the suitable charge transportability can not be obtained to be apt to reduce the sensitivity.

The ozone-deterioration is almost perfectly prevented in the second region and does not to reach the first region, so that it is not necessary to contain the charge transporting materials in the first region in a quantity exceeding the necessary amount. Concretely speaking, it is sufficient that the content of the charge transporting materials in the first region is set at about $\frac{1}{3}$ to 3, preferably about $\frac{1}{2}$ to 2, as referred to as the same ratio as the above described.

By the way, there is a partially overlapped range between the first region and the second region in the content of the charge transporting materials. Namely, as the content of the charge transporting materials in the first region is $\frac{1}{3}$ to 3 while that in the second region is 1 to 9, the overlap occurs in the range of 1 to 3. Therefore, it is necessary to suitably select the content of the charge transporting materials depending upon the kind and the like of the charge transporting materials used in the photosensitive layer. In the present invention, the content of the charge transporting materials in the second region, which is apt to be subjected to the ozone-deterioration, is higher than that in the first region.

The charge transporting materials may be contained in a more increased quantity in the direction to the surface protective layer of the photosensitive layer by the following methods:

(i) In the process of preparing the photosensitive layer, the photosensitive solution containing the charge transporting materials and binder resin in a low concentration is applied first and then the solution containing the charge transporting materials in an increased concentration is applied.

(ii) Photosensitive solutions containing the charge transporting materials and binder resin in various concentrations are applied a plurality of times in turn beginning from the solution containing the charge transporting materials in the lowest concentration.

(iii) The content of the charge transporting materials is gradually increased in the pipings before the spray nozzle and the resulting mixture is applied by the spraying method.

(iv) The solution containing the charge transporting materials and binder resin in a concentration slightly higher than the appointed one is applied to the electrically conductive substrate and dried by heating to form the photosensitive layer and then said photosensitive layer is immersed in suitable solvents which is capable of dissolving said binder resin, such as methanol, ethanol and Flonsolv R, for several seconds to several minutes followed by drying again.

(v) The treatment is carried out in the same manner as in (iv) excepting that the photosensitive layer is exposed to solvent vapors which is capable of dissolving said binder resin for several seconds to several minutes instead of immersing it in the solvents.

The charge transporting materials contained in the second region formed by the above described methods can be variously distributed. But, in the present invention, the charge transporting materials are contained in a more increased quantity in a region closer to the interface between the surface protective layer and the photosensitive layer. The distribution of the charge transporting materials in the second region is illustrated in FIGS. 2 to 5. Referring to the respective drawings, an axis of abscissa indicates a concentration (optional scale) and the point A on an axis of ordinate indicates a position of the interface between the surface protective layer and the photosensitive layer. It is indicated that a certain point is closer to the substrate as it goes downward from the point A.

Figure 2:
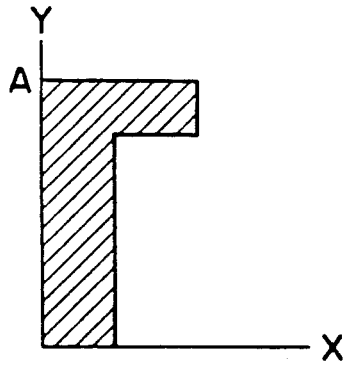
FIGS. 2 to 5 are diagrams showing the distribution of charge transporting materials or antioxidants in a photosensitive layer.

FIG. 2 shows the distribution of the charge transporting materials in the case where the layer containing the charge transporting materials in the specified high concentration is formed in the specified thickness and the layer containing the charge transporting materials in a low concentration is formed under said layer containing the charge transporting materials in a high concentration. Such the distribution expresses well the condition which can be held when it is formed by the above described method (i). In this and following drawings, X axis represents concentration of the charge transporting materials and Y axis represents distance from the substrate (5).

Figure 3:
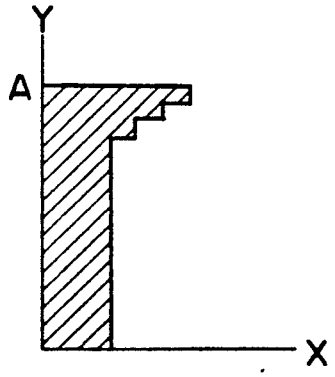

FIG. 3 shows the distribution of the charge transporting materials in the case where the gradient of concentration is given in the layer containing the charge transporting materials in a high concentration in FIG. 2. Such the gradient of concentration expresses well the condition which can be held when the distribution of the charge transporting materials is formed by the above described method (ii).

Figure 4:
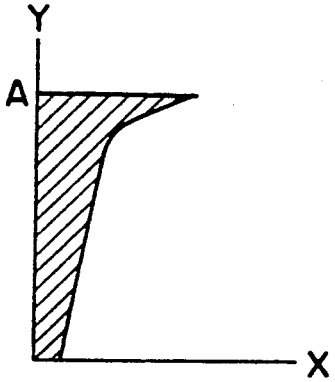
Figure 5:
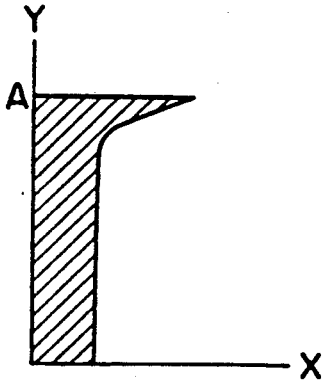

FIG. 4 or 5 shows the condition in the case where the gradient of concentration of the charge transporting materials in the second region is not stepwise as shown in FIGS. 2 and 3 but continuous. Such the gradient of concentration expresses well distributions which can be held when the distribution of the charge transporting materials is formed by the above described methods (iii) to (v).

In every case, the thickness of the respective regions and the concentration of the charge transporting materials are adjusted within the above described ranges.

The internal constitution of the organic photosensitive layer according to the present invention may be either a function-separated type constitution comprising a charge generating layer and a charge transporting layer or a binder type constitution comprising charge generating materials and charge transporting materials dispersed in binder materials. It goes without saying that other constitutions may be applied.

According to the present invention, the ozone-deterioration may be also achieved by containing antioxidants in the second region. In this case, the charge transporting material is used in an usual quantity.

The antioxidants usable in the present invention include known chemical substances, such as amines, for example, N-isopropyl-N'-phenyl-paraphenylenediamine, N-(1,3-dimethylbutyl)-N'-phenyl-paraphenylenediamine, N-(1-methylheptyl)-N'-phenyl-paraphenylenediamine, N,N'-diphenyl-N,N'-di-2-naphthyl-paraphenylenediamine paraphenylenediamine, octylated diphenylamine, Antigen P (made by Sumitomo Kagaku K.K.), Mark LA-63 (made by Adekaa Gas Kagaku K.K.), Noclak 224 (made by Ohuchishinkou Kagaku K.K.) and the like; hydroquinones, for example, 2,2,4-trimethyl-1,2-dihydroquinoline, 2,5-di-t-butylhydroquinone, 2,5-di-t-octylhydroquinone, 2,6-di-n-dodecylhydroquinone, 2-n-dodecylhydroquinone, 2-t-octyl-5-methylhydroquinone and the like; phenols, for example, styrenized phenol, 2,6-di-t-butyl-4-methylphenol, 2,2'-methylene-bis(4-methyl-6-t-butylphenol), 2,2'-methylene-bis(4-ethyl-6-t-butylphenol), 4,4'-thiobis(3-methyl-6-t-butylphenol), 4,4'-bithilydene-bis-(3-methyl-6-t-butylphenol), α-tochophenol-octadecyl-3-(3,5-di-t-butyl-4-hydroxyphenol)-propyonate and the like; hydroxyanisoles, for example, butylhydroxyanisole, dibutylhydroxyanisole and the like; sulfur compounds, for example, 2-mercaptobenzimidazole, dilauryl-3,3'-thiodipropyonate and the like; and organo phosphorus compounds, for example triphenyl phosphine, tris(nonylphenyl)phosphine and tricrezol phosphine.

The content of the antioxidants in the second region is set at 1/10 to 3, preferably 1/5 to 2, as referred to as a ratio of weight of the antioxidants to a weight of the constituent resins of the photosensitive layer. If the content of the antioxidants is excessively high, the charge transporting function of the photosensitive layer is hindered to deteriorate the sensitivity. On the contrary, the excessively low content of the antioxidants does not lead to the effective prevention of the ozone-deterioration.

The ozone-deterioration is almost perfectly prevented in the second region, and so the antioxidants may not always be contained or may be contained in a small quantity in the first region. Concretely speaking, it is sufficient that the content of the antioxidants in the first region is set at about 0 to ½, preferably about 0 to 1/10, as referred to as the same ratio as the above described one.

By the way, there is a partially overlapped range between the first region and the second region in the content of the antioxidants. Namely, as the content of the antioxidants in the second region is 1/10 to 3 while that in the first region is 0 to ½, the overlap occurs in the range of 1/10 to ½. Therefore, it is necessary to suitably select the content of the antioxidants depending upon the kind of the charge transporting materials used for the photosensitive layer, the kinds of the antioxidants and the like. In the present invention, the content of the antioxidants in the second region, which is apt to be subjected to the ozone-deterioration, is higher than that in the first region.

The antioxidants may be contained in a more increased quantity in the direction to the surface protective layer of the photosensitive layer by the following methods:

(vi) In the process of preparing the photosensitive layer, the photosensitive solution containing the antioxidants in a low concentration is applied first and then the solution containing the antioxidants in an increased concentration is applied.

(vii) Photosensitive solutions containing the antioxidants in various concentrations are applied a plurality of times in turn beginning from the solution containing the antioxidants in the lowest concentration.

(viii) The content of the antioxidants is gradually increased in the pipings before the spray nozzle and the resulting mixture is applied by the spraying method.

The antioxidants contained in the second region formed by the above described methods can be variously distributed. But, in the present invention, the antioxidants are contained in a more increased quantity in a region with being closer to the interface between the surface protective layer and the photosensitive layer. The distributions of the antioxidants in the second region may be illustrated in FIGS. 2 to 5, in a distribution similar to that of the charge transporting materials. Characteristic distributions of the antioxidants are shown in FIGS. 6-9.

Figure 6:
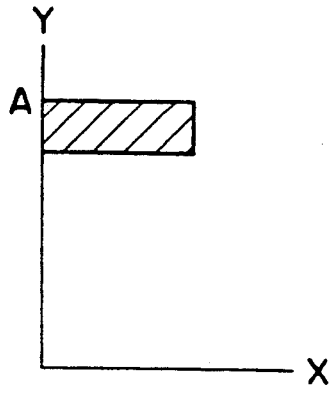
FIGS. 6 to 9 are diagrams showing the distribution of antioxidants in a photosensitive layer.

As shown in FIG. 6, the layer containing the antioxidants in the specified high concentration is formed in the specified thickness and the layer containing the antioxidants in a low concentration is formed under said layer containing the antioxidants in a high concentration. Such the distribution expresses well the condition which can be held when it is formed by the above described method (vi).

Figure 7:
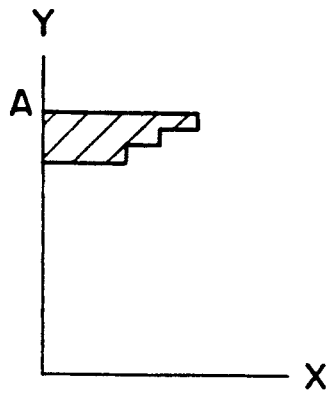
Figure 8:
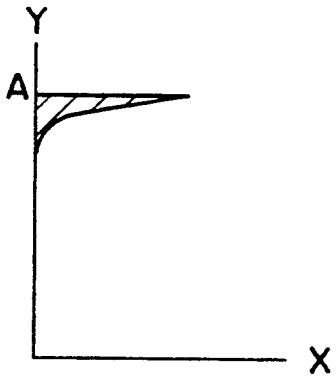
Figure 9:
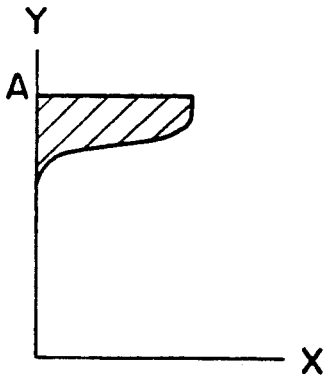

FIG. 7 shows the distribution in the case where the region containing the antioxidants in a low concentration formed in FIG. 2 is not formed.

The gradient of concentration may be given in the layer containing the antioxidants in a high concentration as shown in FIG. 3 and FIG. 7, respectively. Such the gradient of concentration expresses well the condition which can be held when the distribution of the antioxidants is formed by the above described method (vii).

The gradient of concentration may be stepwise as in shown FIG. 2, FIG. 3, FIG. 6, FIG. 7 but may be also continuous as shown in FIG. 4, FIG. 5, FIG. 8 and FIG. 9. Such the gradient of concentration expresses well distribution which can be held when the distribution of the antioxidants is formed by the above described method (viii).

In every case, the thickness of the respective regions and the concentration of the antioxidants are set within the above described ranges.

Figure 10:
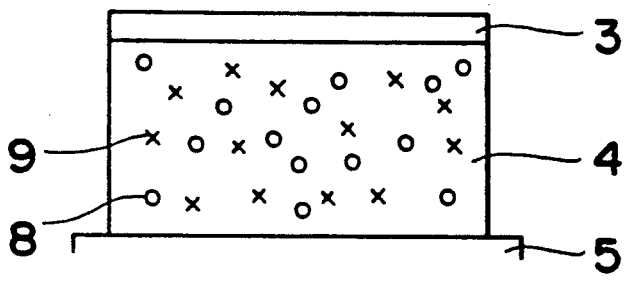
FIGS. 10 to 12 are schematic sectional views showing constitutions of photosensitive members to which the present invention can be applied.
Figure 11:
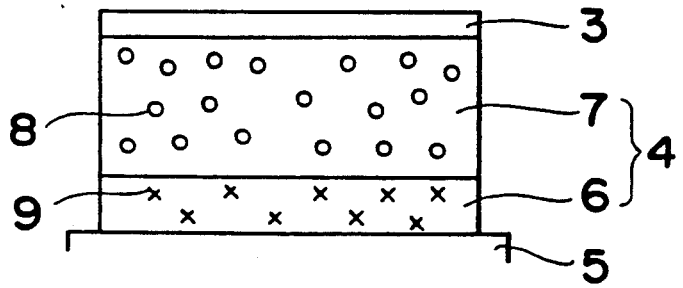
Figure 12:
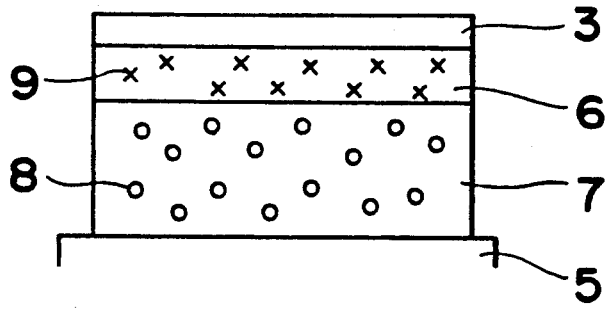

The constitutions of the photosensitive members, to which the present invention can be applied, are illustrated in FIGS. 10 to 12.

FIG. 10 shows the photosensitive member having the same constitution as shown in FIG. 1 and comprising an electrically conductive substrate (5), a photosensitive layer (4) with charge generating materials (9) and charge transporting materials (8) incorporated in binders formed on said electrically conductive substrate (5) and a surface protective layer (3) formed on said photosensitive layer (4).

A layer containing the antioxidants or the charge transporting materials in a gradient concentration is formed under the interface between the surface protective layer (3) and the photosensitive layer (4).

FIG. 11 shows a function-separated type photosensitive member comprising a charge generating layer (6) and a charge transporting layer (7) as the photosensitive layer (4), said charge transporting layer (7) being formed on said charge generating layer (6). A layer containing the antioxidants or the charge transporting materials in a gradient concentration is formed in a region closer to the surface protective layer (3) in said charge transporting layer.

FIG. 12 shows a function-separated type photosensitive member comprising a charge generating layer (6) and a charge transporting layer (7), but said charge generating layer (6) is formed on said charge transporting layer (7) contrary to FIG. 11.

In this case of FIG. 12, the thickness of the charge generating layer is usually 4 μm or less, so that it often becomes necessary that the region containing the antioxidants in a gradient concentration (in particular a second region) is formed extending over both the charge generating layer (6) and the charge transporting layer (7).

When the region containing the charge transporting materials in a gradient concentration is formed, it is formed in the charge transporting layer, not being formed in the charge generating layer (6). The charge transporting materials are contained in a more increased quantity in a region closer to the charge generating layer.

In the photosensitive member having the constitution shown in FIG. 11, the thickness of the charge transporting layer is usually 5 to 30 μm, so that it is not usual in view of the simplification of the method of manufacture that the layer containing the antioxidants is formed extending into the charge generating layer (6).

In addition, in the photosensitive members shown in FIGS. 10 to 12, an undercoat layer (intermediate layer) may be formed on the substrate (5).

An organic photosensitive layer used in the present invention is not particularly limited, so far as the organic photosensitive layer is capable of giving photosensitive properties required for a photosensitive member, such as the desired sensitivity and chargeability.

In general ,with respect to the materials used for the formation of the organic photosensitive layer, the photoconductive materials contributing to the charge generation include, for example, phthalocyanine pigments, azo dyes, perylene pigments and the like, and the charge transporting materials contributing to the charge transportation include, for example, triphenyl methane compounds, triphenyl amine compounds, hydrazone compounds, styryl compounds, pyrazoline compounds, oxasole compounds, oxadiazole compounds and the like. In addition, the binder materials for dispersing the charge generating materials and/or the charge transporting materials therein include resins, such as polyester resins, polyamide resins, polyvinyl butyral resins, vinyl chloride resins, polycarbonate resins, polyacrylate resins, phenoxy resins, styrene acrylic resins, cellulose ester resins, acrylic resins, epoxy resins, urethane resins, silicone resins, phenolic resins, melamine resins, alkyd resins, ethylene-acetic acid copolymers, ethylene-butadiene copolymers and the like. It is desired that the binder material itself has a volume resistance of $1\times10^{14}$ ohm or more.

The applying methods, such as a dip coating method, a spray coating method, a spinner coating method, a wire bar coating method, a blade coating method, a roller coating method, a curtain coating method and the like, may be used for the formation of the photosensitive layer of the photosensitive member according to the present invention. It is preferable that the photosensitive layer formed by such the applying methods is preliminarily dried at room temperature and then dried by heating. The drying by heating can be conducted for about 5 minutes to 2 hours at temperatures of 30 to 200° C. under the stationary or ventilating condition.

A surface protective layer composing the photosensitive member in the present invention capable of exhibiting the following functions may be used. That is to say, the surface protective layer is not specially limited and the thickness of the surface protective layer is usually about 0.01 to 5 μm.

The light-transmittance is high to efficiently introduce the incidental light into the photosensitive layer and the sensitivity characteristics as the photosensitive member are not deteriorated.

The hardness and wear resistance are excellent to prevent the photosensitive layer from being worn, and the reduction of surface potential or the reduction of sensitivity resulting from the wearing of the layer can be prevented.

The environmental resistance is high to protect the characteristics of the photosensitive member from the change of temperature and humidity, the change of gaseous atmosphere and the like.

The matching to the developers is high to prevent the generation of the filming phenomenon, the fusion of toners and the like.

The matching to cleaning members, such as a cleaner blade, is high to prevent the noises from the blade, the poor rotation of the drum and the like.

The surface protective layer may be prepared in vacuum, for example, by a vacuum deposition method, a cluster deposition method, a sputtering method, a reactive sputtering method, an ion-plating method or the like, and includes vacuum thin layers formed of inorganic compounds, such as $A1_2O_3$, SiO, $SiO_2$, $TiO_2$, CaO, $CeO_2$, $Ce_2O_3$, $Bi_2O_3$, $Cr_2O_3$, $Gd_2O_3$, $SnO_2$, $Sb_2O_3$, $Sb_2O_4$, $La_2O_3$, $Ta_2$, $O_5$, $ThO_2$, $ZrO_2$, ZnS, CdS, PbS, $MgF_2$, LiF, $CaF_2$, $CeF_3$, $LaF_3$, $PbF_3$, $NdF_3$, $Si_3N_4$, $Si_3N_4$: $Al_2O_3$, $Si_3N_4$:MgO, $Si_3N_4$: SiC and $Si_3N_4$: $SiO_2$, vacuum thin layers formed of organic compounds, such as fluorine resins, for example, polytetrafluoroethylene, polyvinylidene fluoride and tetrafluoroethylene-hexafluoropropylene copolymers, polyparaxylylene resins, polyethylene resins, polypropylene resins, polystyrene resins, polyamide resins, polyimide resins, polyacetal resins, polycarbonate resins, methacrylic resins, acrylonitrile-styrene copolymers, acrylonitrile-butadiene-styrene copolymers and butadiene-styrene-methacrylate copolymers, or vacuum thin layer formed of composites thereof.

Vacuum thin layers composed of amorphous carbon (a-C), amorphous silicon (a-Si) and amorphous silicon carbide (a-SiC) prepared by a plasma polymerization or vacuum thin layers composed of these amorphous materials with hetero atoms, such as hydrogen atoms, oxygen atoms, nitrogen atoms, fluorine atoms, boron atoms and phosphorus atoms, added thereto may be used. Also such the vacuum thin layers having a microcrystalline structure, a polycrystalline structure, a crystalline structure and the like can be used in addition to those having an amorphous structure.

The materials available on the market include photosetting resins, such as Zonne KPM 2000, Zonne KPM 2100 (made by Kansai Paint K.K.), Diabeam UA, Diabeam UB, Diabeam UC and Diabeam UD (made by Mitsubishi Rayon K.K.) and the like; thermosetting resins, such as Magicron No. 200, Magicron No. 300, Magicron No. 500, Magicron No. 1500 (made by Kansai Paint K.K.) and Almatex E 2404, Almatex E 162 (made by Mitsui Toatsu Kagaku K.K.), and normal temperature setting resins such as Almatex L 1042, Almatex L 1043, Almatex L 1090F (made by Mitsui Toatsu Kagaku K.K.).

These resins may be used singly or in combination. In addition, the surface protective layer may has either the single-layer structure or the multi-layer structure.

The electrically conductive substrate includes metallic substrates having the electrical conductivity in themselves, such as aluminum, aluminum alloys, copper, zinc, stainless steels, vanadium, molybdenum, chromium, titanium, nickel, indium, gold and platinum; substrates composed of plastic materials (for example polyethylene, polypropylene, polyvinyl chloride, polyethylene terephthalate, acrylic resins, polyfluoroethylene and the like), on which the electrically conductive layer is formed by a vacuum vapor coating method, a sputtering method and the like; substrates on which electrically conductive particles (for example, carbon black, carbon fiber, silver particles, metallic flakes and the like) are coated together with suitable binders; substrates composed of plastics or papers impregnated with electrically conductive particles; substrates composed of plastic materials containing electrically conductive polymers, and the like.

In addition, the shape of the substrate may be optionally selected depending upon the electrophotographic machine used. A cylindrical photosensitive member, a flexible belt-like photosensitive member, a flat plate-like photosensitive member and the like may be used.

The present invention is below described with reference to the preferred embodiments.

EXAMPLE 1

Preparation of the charge generating layer (CGL)

A mixture solution of Chloro-dian-Blue (CDB) as the bisazo dyes of 1 g, polyester resin (V-200 made by Toyobo K.K.) of 1 g and cyclohexanone of 98 g was dispersed for 13 hours by means of a sand grinder.

The resulting dispersion was applied to a cylindrical aluminum substrate having a diameter of 80 mm by a dipping method so that the layer-thickness might be 0.3 μm after drying. Thus, a charge generating layer (CGL) was prepared.

Preparation of the charge transporting layer (CTL)

A mixture of a pyrazoline compound represented by the following structural formula [I] of 5 g, polycarbonate (K-1300; made by Teijin Kasei K.K.) of 10 g and THF of 50 g was applied to the CGL and then dried so that the layer-thickness might be 15 μm after drying to form the charge transporting layer (the first region) having a ratio of a weight of the charge transporting materials to a weight of resins = 1:1.

[I]

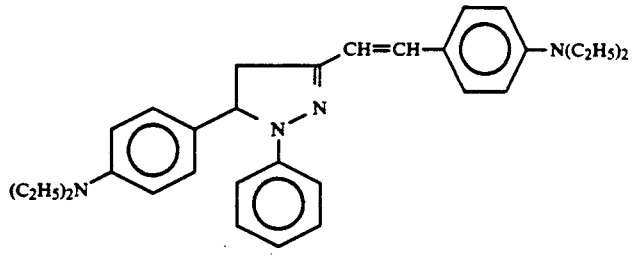

The mixture solution of the pyrazoline compound represented by the structural formula [I] of 10 g, polycarbonate (K-1300; made by Teijin Kasei K.K.) of 5 g and THF of 100 g was applied and then dried so that the layer-thickness might be 1 μm after drying to form a charge transporting layer (the second region) having a ratio of a weight of the charge transporting materials to a weight of resins = 2.

Preparation of the surface protective layer (OCL)

The a-C surface protective layer was formed under the following conditions in a common plasma polymerization apparatus.

| | | |
|---|---|---|
| Carrier gas | Ar | 200 sccm |
| Raw material gas | $C_3H_6$ (propylene) | 30 sccm |
| Frequency | 1 MHz | |
| Electric power | 120 W | |
| Pressure | 0.3 Torr | |
| Substrate temperature | 30° C. | |
| Layer-thickness | 0.9 μm | |

EXAMPLES 2 TO 4, COMPARATIVE EXAMPLES 1 to 2

Photosensitive members were prepared in a manner similar to Example 1 excepting that the second region of the CTL was formed under the conditions as shown in Table 1.

TABLE 1

| | Structural formula [I] | Poly-carbonate | THF | CT/ Resin | Layer-thickness |
|---|---|---|---|---|---|
| Com. Ex. 1 | 5 g | 10 g | 50 g | ½ | 1 μm |
| Ex. 3 | 10 g | 10 g | 100 g | 1 | 1 μm |
| Ex. 1 | 10 g | 5 g | 100 g | 2 | 1 μm |
| Ex. 2 | 21 g | 3 g | 100 g | 7 | 1 μm |
| Ex. 4 | 18 g | 2 g | 100 g | 9 | 1 μm |
| Com. Ex. 2 | 24 g | 2 g | 100 g | 12 | 1 μm |

EXAMPLES 5 TO 7, COMPARATIVE EXAMPLES 3 to 4

Photosensitive members were prepared in a manner similar to Example 1 excepting that the layer-thickness of the second region of the CTL was changed as shown in Table 2.

TABLE 2

| | Layer-thickness |
|---|---|
| Comparative Example 3 | 0.1 μm |
| Example 6 | 0.2 μm |
| Example 1 | 1 μm |

TABLE 2-continued

| | Layer-thickness |
|---|---|
| Example 5 | 4 μm |
| Example 7 | 5 μm |
| Comparative Example 4 | 7 μm |

EXAMPLE 8

A photosensitive member was prepared in a manner similar to Example 3, excepting that the second region was prepared in the following manners, a part of the second region was first prepared in a manner similar to Example 3 except that the thickness thereof was 0.5 μm, and then a mixture solution of the pyrazoline compound represented by the structural formula [I] of 10 g, polycarbonate (K-1300; made by Teijin Kasei K.K.) of 10 g, antioxidant: Noclak 224 (made by Ohuchi Shinko Kagaku K.K.) of 2 g and THF of 100 g was applied onto the above prepared the part of the second region by the dipping method and then dried so that the layer-thickness of the charge transporting layer (a part of the second region) having a ratio of a weight of the antioxidants to a weight of resins=1:5 might be 0.5 μm after drying.

EXAMPLE 9

A photosensitive member was produced in a manner similar to Example 1 excepting that the CTL layer was prepared in the following manner.

(Preparation of CTL

At first, a solution having the following compositions was applied and then dried so that the layer-thickness might be 15.2 μm after drying.

| | |
|---|---|
| Pyrazoline represented by the structural formula [I] | 6 g |
| Polycarbonate | 10 g |
| THF | 200 g |

Figure 13:
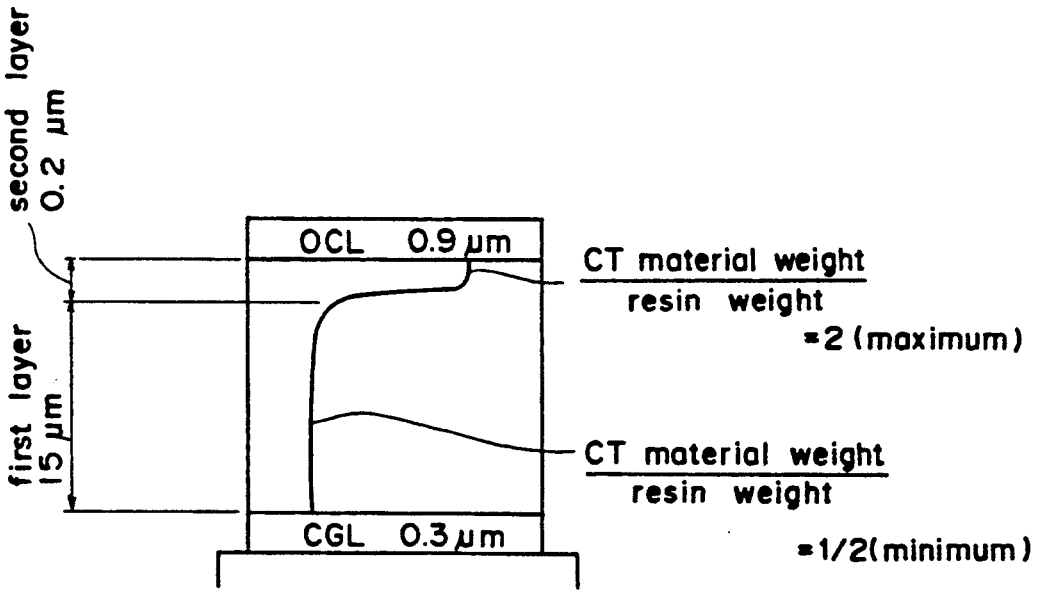
FIG. 13 is a diagram showing an outline of the distribution of the charge transporting materials in the photosensitive member obtained in Example 9.

Subsequently, the drum, which had been dried, was exposed to the THF vapor for 10 minutes and dried again. The charge transporting layer with the charge transporting materials maldistributed in the upper portion of the charge transporting materials as shown in FIG. 13 was prepared by this procedure since the THF vapor dissolves the binder resin of said polycarbonate. The distribution of charge transporting materials shown in FIG. 13 can be measured by the organic elemental analysis.

EXAMPLE 10

Preparation of the charge generating layer (CGL)

A mixture solution of Chloro-dian-Blue (CDB) as the bisazo pigment of 1 g, polyester resin (V-200 made by Toyobo K.K.) of 1 g and cyclohexanone of 98 g was dispersed for 13 hours by means of a sand grinder.

The resulting dispersion was applied to a cylindrical aluminum substrate having a diameter of 80 mm by a dipping method to form a charge generating layer (CGL) so that the layer-thickness might be to 0.3 μm after drying.

Preparation of the charge transporting layer (CTL)

A mixture solution of the pyrazoline compound represented by the above structural formula [I] of 5 g, polycarbonate (K-1300; made by Teijin Kasei K.K.) of 10 g and THF of 50 g was applied to the CGL and dried so that the layer-thickness of the charge transporting layer (the first region) having a ratio of a weight of the CT materials to a weight of resins=1:2 might be 15 μm after drying.

Subsequently, the second region was formed in the following manner.

A mixture solution of the pyrazoline compound represented by the structural formula [I] of 5 g, polycarbonate (K-1300 made by Teijin Kasei K.K.) of 10 g, antioxidant: Noclak 224 (made by Ohuchi Shinko Kagaku K.K.) of 2 g and THF of 100 g was applied by a dipping method and dried so that the layer-thickness of the charge transporting layer (the second region) having a ratio of a weight of the antioxidants to a weight of resins=1:5 might be 1 μm after drying.

Preparation of the surface protective layer (OCL)

The a-C surface protective layer was formed under the following conditions in the usual plasma polymerization apparatus.

| | | |
|---|---|---|
| Carrier gas | Ar | 200 sccm |
| Raw material gas | $C_3H_6$ (propylene) | 30 sccm |
| Frequency | 1 MHz | |
| Electric power | 120 W | |
| Pressure | 0.3 Torr | |
| Substrate temperature | 30° C. | |
| Layer-thickness | 0.9 μm | |

EXAMPLES 11 to 13, COMPARATIVE EXAMPLES 5, 6

Photosensitive members were prepared in a manner similar to Example 10 excepting that the second region in the CTL was prepared as shown in Table 3.

TABLE 3

| | Structural formula [I] | resin: polycarbonate | anti-oxidant: Noclak 224 | THF | ratio of anti-oxidant to resin | Layer thickness |
|---|---|---|---|---|---|---|
| Ex. 10 | 5 g | 10 g | 2 g | 100 g | 1/5 | 1 μm |
| Ex. 11 | 5 g | 10 g | 20 g | 200 g | 2 | 1 μm |
| Ex. 12 | 5 g | 10 g | 1 g | 100 g | 1/10 | 1 μm |
| Ex. 13 | 5 g | 10 g | 30 g | 200 g | 3 | 1 μm |
| Com. Ex. 5 | 5 g | 10 g | 0.5 g | 100 g | 1/20 | 1 μm |
| Com. Ex. 6 | 5 g | 10 g | 40 g | 200 g | 4 | 1 μm |

EXAMPLE 14 to 16, COMPARATIVE EXAMPLES 7, 8

Photosensitive members were produced in a manner similar to Example 10 excepting that the layer-thickness of the second region in the CTL was changed as shown in Table 4.

TABLE 4

| | Layer-thickness |
|---|---|
| Example 10 | 1 μm |
| Example 14 | 4 μm |
| Example 15 | 0.2 μm |
| Example 16 | 5 μm |
| Comparative Example 7 | 0.1 μm |
| Comparative Example 8 | 7 μm |

EVALUATION

The photosensitive members (Examples 1 to 16, Comparative Examples 1 to 8) obtained in the above described manner were evaluated on the following items.

| | |
|---|---|
| (i) Testing apparatus | Copying machine EP 490Z made by Minolta Camera K.K.. Scorotron type charger was used as the main charger. |
| (ii) Measurement of the electric potential | Surface potentiometer MODEL 344 made by TREK K.K. was used. The probe was set at the position of the developer of the copying machine EP490Z to measure the surface potential of the photosensitive member. |
| (iii) Measurement of the layer-thickness | The layer-thickness meter (Type EC8e2Ty made by FISCHER K.K.) was used to measure the layer-thickness of the photosensitive member. |
| (iv) Durability test with respect to copy | The durability test with respect to copy was conducted in an indoor environment by the use of the copying machine EP490Z and a chart having a B/W ratio of 6% in a mode of the lateral feeding of A4 paper. In the first stage, * the output of the charger was adjusted so that initial surface potential ($V_0$) might be −500 [V] and * the exposure $E_{50}$ necessary to reduce the surface potential to −50 V was measured. prior to the durability test with respect to copy, * the surface potential $V_o$ and $V_i$ was measured after every 5K times of copy while keeping the output of the charger and $E_{50}$ as above determined. * $V_i$ is a surface potential after irradiated with the light amount of $E_{50}$. |

EVALUATION RESULTS

The values of $E_{50}$ in the first stage are shown in the following Table 5 and Table 6.

TABLE 5

| Example/Comparative Example | $E_{50}$ (lux · sec) |
|---|---|
| Example 1 | 5.3 |
| Example 2 | 4.8 |
| Example 3 | 5.6 |
| Example 4 | 4.4 |
| Example 5 | 4.9 |
| Example 6 | 5.5 |
| Example 7 | 4.2 |
| Example 8 | 5.2 |
| Example 9 | 5.4 |
| Comparative Example 1 | 6.1 |
| Comparative Example 2 | 3.2 |
| Comparative Example 3 | 5.8 |
| Comparative Example 4 | 3.8 |

The change of $V_o$ and $V_i$ during the durability test with respect to copy are shown in FIGS. 14 to 17.

Figure 14:
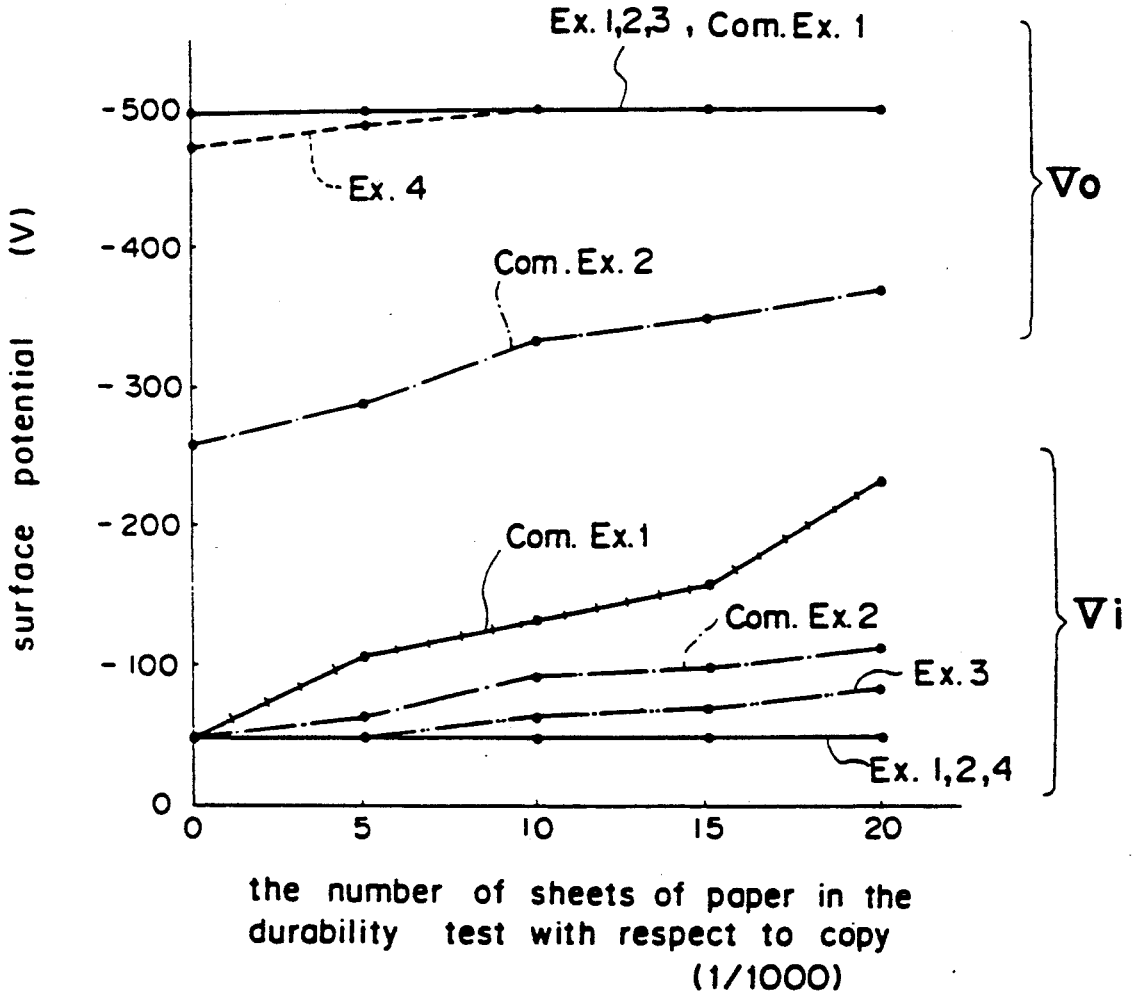
FIGS. 14 to 19 are diagrams showing changes of a surface potential of photosensitive members in the durability test with respect to copy.

It is found from FIG. 14 that the photosensitive members obtained in Examples 3, 4 exhibited the reduction of sensitivity and the decrease of $V_o$, but the reduction and decrease arose no practical problems.

It is found that the photosensitive member obtained in Comparative Example 1 exhibited a remarkable reduction of sensitivity and the photosensitive member obtained in Comparative Example 2 exhibited a remarkable decrease of $V_o$.

The suitable value of the content of the charge transporting materials could be found from FIG. 14 and Table 1.

Figure 15:
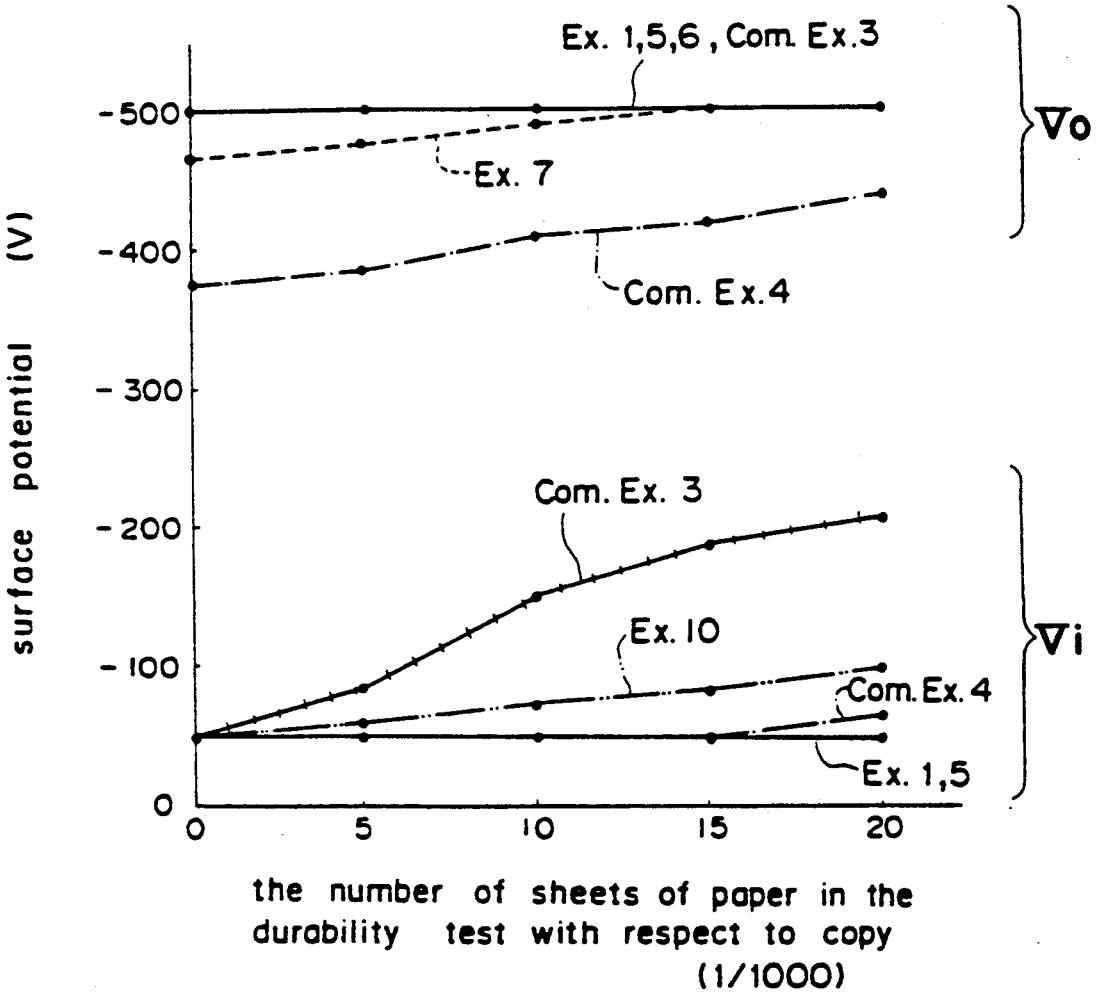
Figure 16:
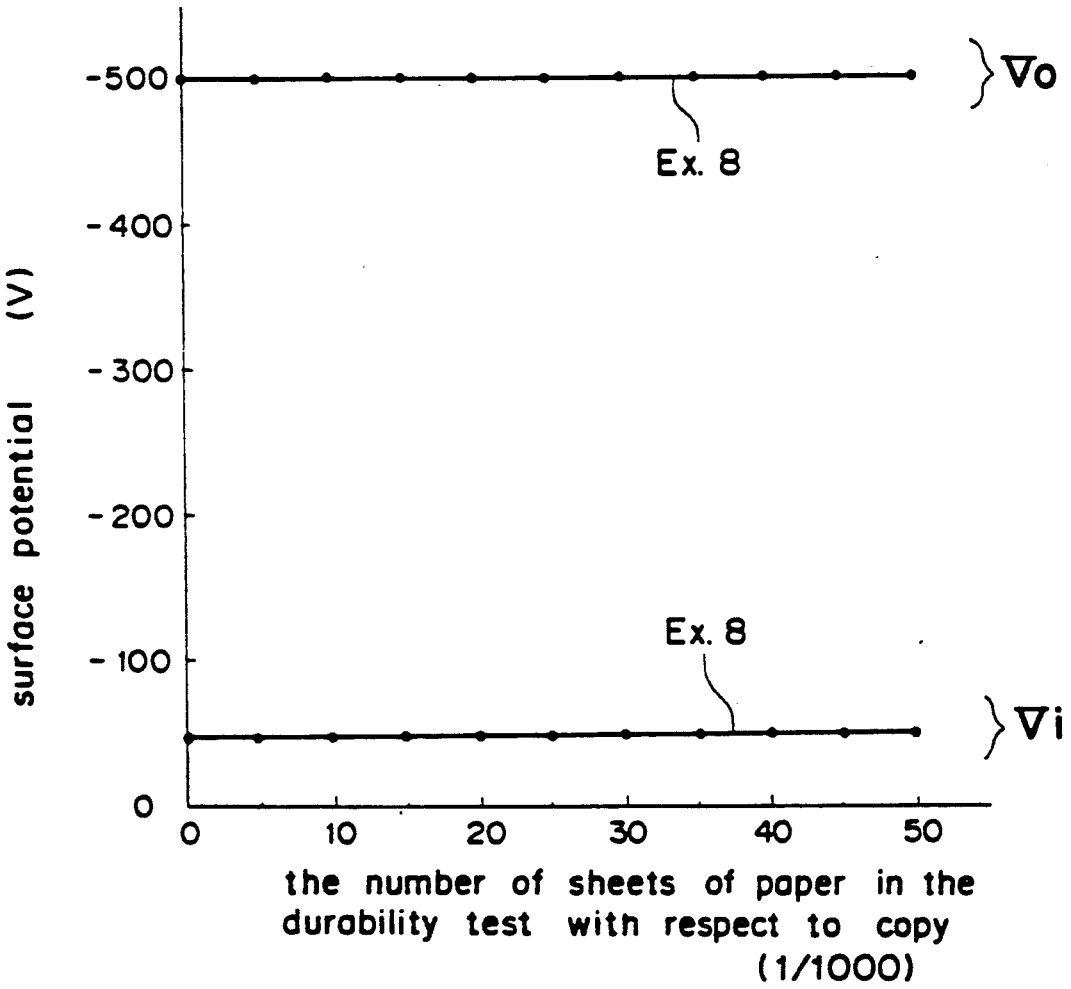
Figure 17:
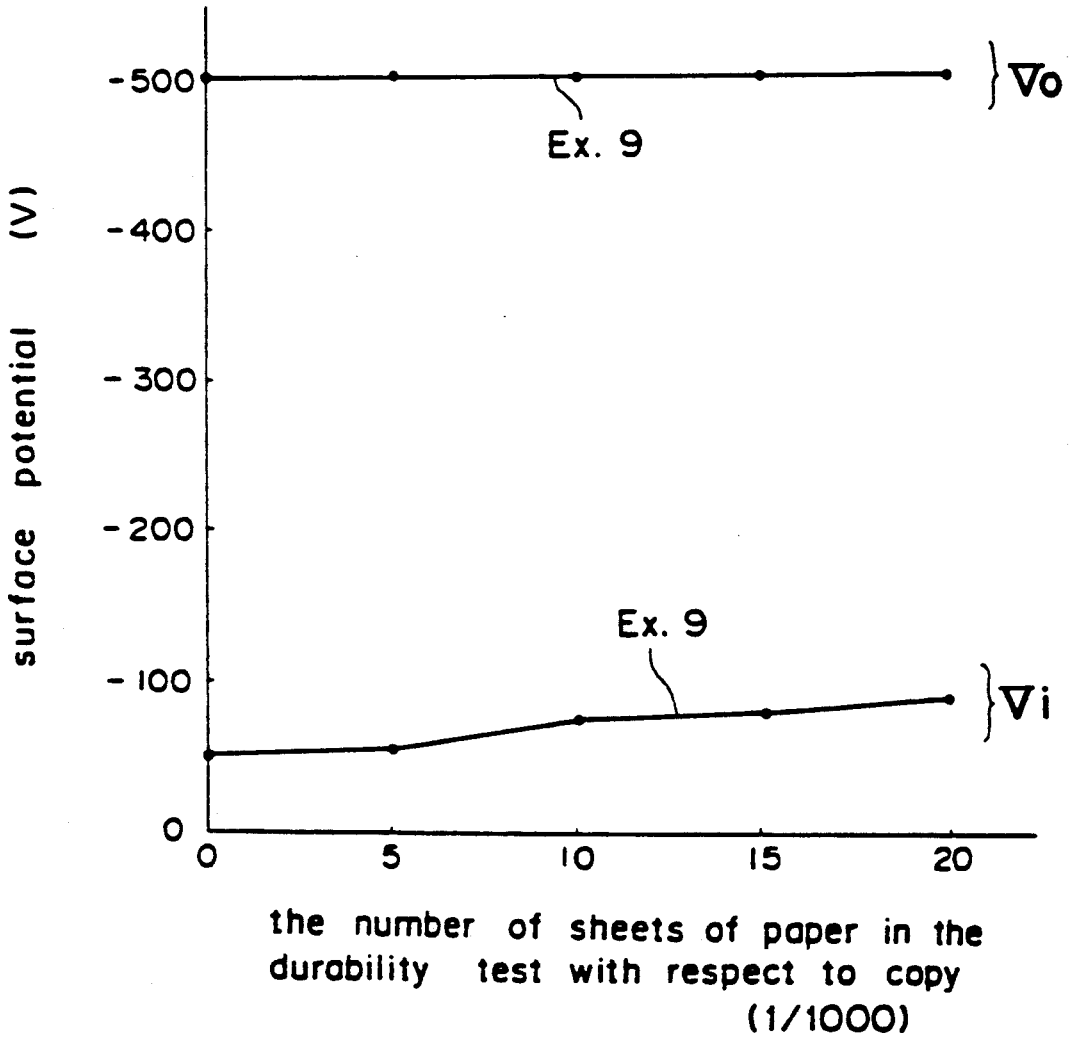

In addition, the suitable value of the layer-thickness of the second region could be found from FIG. 15 and Table 2. Furthermore, every sample did not exhibit the shaving of the layer during the durability test with respect to copy.

TABLE 6

| Example/Comparative Example | $E_{50}$ (lux · sec) |
|---|---|
| Example 10 | 5.8 |
| Example 11 | 6.0 |
| Example 12 | 5.6 |
| Example 13 | 8.7 |
| Example 14 | 6.9 |
| Example 15 | 5.6 |
| Example 16 | 9.1 |
| Comparative Example 5 | 5.1 |
| Comparative Example 6 | 24.6 ($E_{100}$) |
| Comparative Example 7 | 5.3 |
| Comparative Example 8 | 33.4 ($E_{100}$) |

It is found that the photosensitive members obtained in Examples 13, 16 exhibited $E_{50}$ exceeding 8.0, so that there is no practical problem but it is necessary to increase the electric power of the exposure light source and the sensitivity is slightly deteriorated.

The photosensitive members obtained in Comparative Examples 6, 8 could be reduced to −50 V even though the exposure amount was increased up to 50 by changing the exposure lamp. Therefore, their $E_{50}$ were not obtained. The light amount of 20 or more was required for $E_{100}$ (the exposure amount necessary to decrease the surface potential to 100 V) and thus they could not be put into practical use. Accordingly, their durability tests with respect to copy were not conducted.

Figure 18:
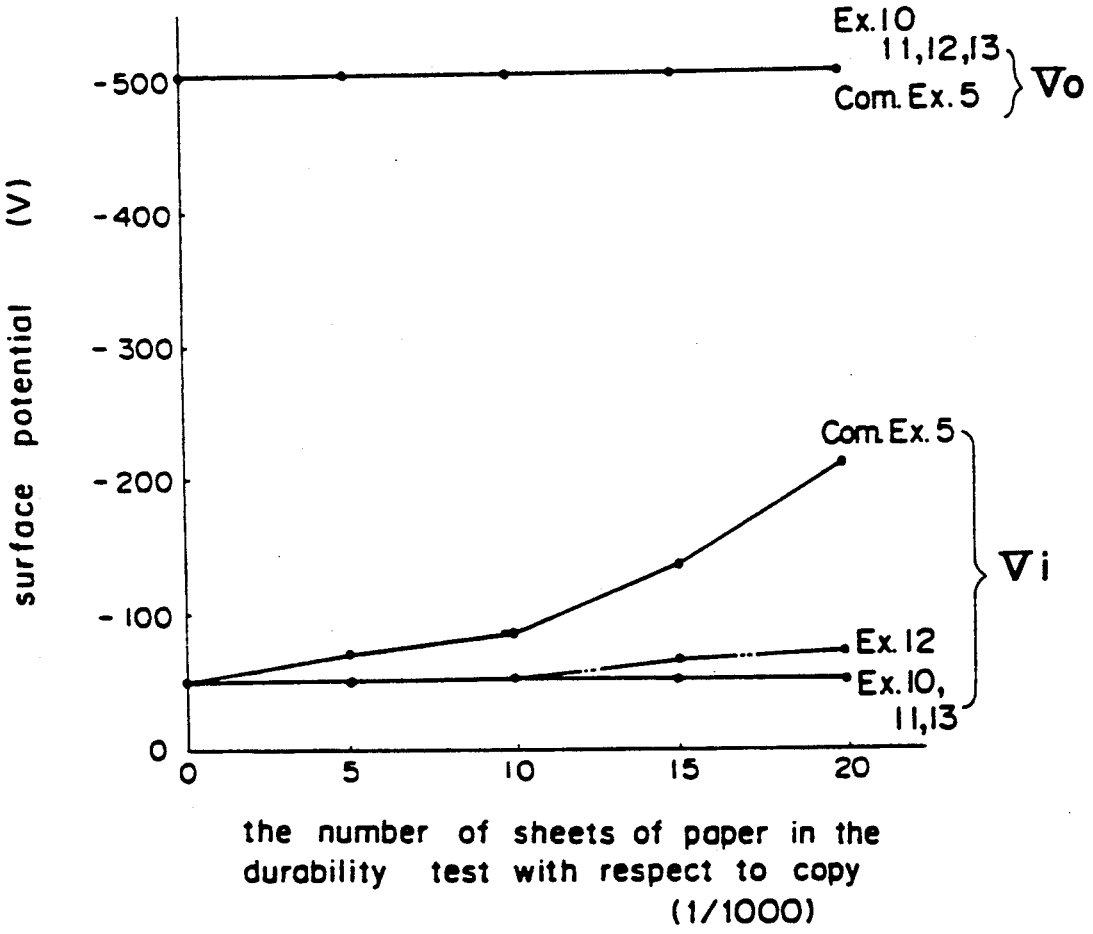
Figure 19:
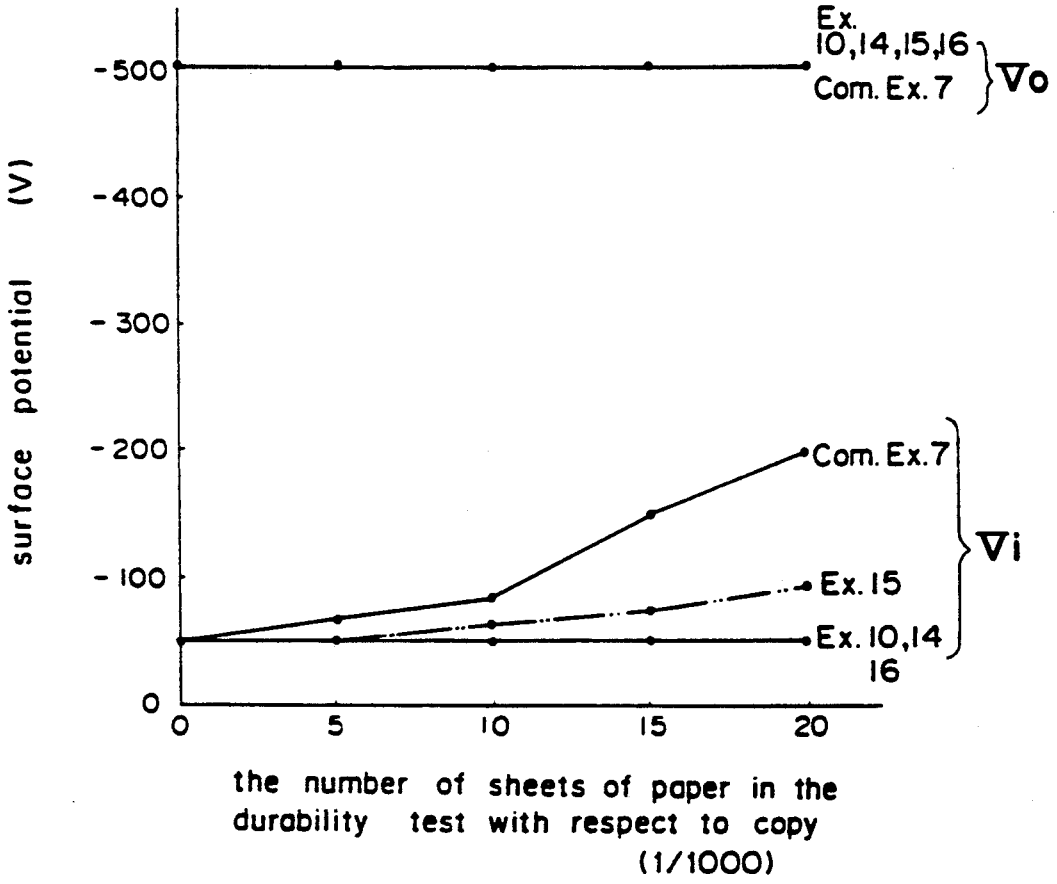

The changes of $V_o$ and $V_i$ during the durability test with respect to copy were shown in FIGS. 18 and 19.

It is found from FIG. 18 that the photosensitive member containing the antioxidants in a low content prepared in Comparative Example 5 increases $V_i$ as it was repeatedly used.

It is found from FIG. 19 that the photosensitive member having the low layer-thickness of the region containing the antioxidants prepared in Comparative Example 7 increased $V_i$ as it was repeatedly used.

What is claimed is:

1. A photosensitive member comprising:
an electrically conductive substrate,
a surface protective layer, and
a photosensitive layer formed between the substrate and the protective layer and including a charge transporting material in such a manner that quantity of the charge transporting material increases with being closer to the interface between the protective layer and the photosensitive layer.

2. A photosensitive member of claim 1, in which the photosensitive layer comprises a binder resin.

3. A photosensitive member of claim 1, in which the surface protective layer comprises an amorphous hydrocarbon layer prepared by a plasma-polymerization.

4. A photosensitive member comprising:
an electrically conductive substrate,
a surface protective layer, a charge generating layer formed on the electrically conductive substrate, and a charge transporting layer formed between the charge generating layer and the protective layer and including a charge transporting material in such a manner that quantity of the charge transporting material increases with being closer to the interface between the protective layer and the photosensitive layer.

5. A photosensitive member comprising:

an electrically conductive substrate, a surface protective layer, and a photosensitive layer formed between the substrate and the protective layer, said photosensitive layer comprising a first region containing a charge transporting material and a second region containing a charge transporting material more than the first region, the second region being positioned between the first region and the protective layer.

6. A photosensitive member of claim 5, in which the charge transporting material is contained in the second region at 1/1-9/1 referred to as a ratio of a weight of the charge transporting material to a weight of a binder resin.

7. A photosensitive member of claim 5, in which the second region is 0.2-5 μm in thickness.

8. A photosensitive member of claim 5, in which the charge transporting material is contained in the first region at ⅓-3/1 referred to as a ratio of a weight of the charge transporting material to a weight of a binder resin.

9. A photosensitive member of claim 5, in which the first region is 10-25 μm in thickness.

10. A photosensitive member of claim 5, in which the surface protective layer is 0.01-5 μm in thickness.

11. A photosensitive member of claim 5, in which an intermediate layer is formed between the electrically conductive substrate and the photosensitive layer.

12. A photosensitive member of claim 11 in which the intermediate layer is 0.01-5 μm in thickness.

* * * * *